US005393069A

United States Patent [19]

Taylor

[11] Patent Number: 5,393,069

[45] Date of Patent: Feb. 28, 1995

[54] RETRACTABLE BACKBOARD SUSPENDED NOT SUPPORT

[75] Inventor: Stevie E. Taylor, Franklinville, N.C.

[73] Assignee: Eugene V. Hearl, Summerfield, N.C. ; a part interest

[21] Appl. No.: 202,294

[22] Filed: Feb. 25, 1994

[51] Int. Cl.[6] ..... A63B 61/00

[52] U.S. Cl. ..... 273/411; 273/1.5 R; 273/29 BF

[58] Field of Search ..... 273/411, 29 B, 29 BB, 273/1.5 R, 1.5 A

[56] References Cited

U.S. PATENT DOCUMENTS

| | | | |
|---|---|---|---|
| 3,938,806 | 2/1976 | Husbands | 273/411 |
| 3,940,139 | 2/1976 | Barnes | 273/411 |
| 4,122,451 | 10/1978 | Senoh | 273/29 BF |
| 4,153,247 | 5/1979 | Burns | 273/29 R |
| 4,307,887 | 12/1981 | Weiss | 273/411 |
| 4,844,477 | 7/1989 | Pardi | 273/29 BD |
| 4,973,059 | 11/1990 | Stewart | 273/411 |
| 5,062,646 | 11/1991 | Crist | 273/411 |
| 5,215,310 | 6/1993 | Aubright | 273/411 |

*Primary Examiner*—William H. Grieb

*Attorney, Agent, or Firm*—Rhodes, Coates & Bennett

[57] ABSTRACT

A retractable net support including a frame, a carriage, a net support post mounted on the carriage, and a coupling connected to the support post for securing the end of a net. The carriage is movably mounted on the frame such that it may be selectively positioned along the frame. The frame further includes a top mount and a bottom mount configured and arranged to secure the net support to a backboard. Preferably, the carriage is selectively positionable by means of a threaded rod rotatably mounted on the frame. By rotating the threaded rod by means of a crank, the carriage, and thereby the attached net, may be raised and lowered.

18 Claims, 4 Drawing Sheets

RETRACTABLE BACKBOARD SUSPENDED NOT SUPPORT

FIELD OF THE INVENTION

The present invention is directed to equipment for net games, and, more particularly, to a suspended net support for net games such as volleyball and badminton.

BACKGROUND OF THE INVENTION

Games such as volleyball and badminton are played using a net. Conventional apparatus for supporting the net in these games include stationary, permanent posts, posts designed to have one end imbedded in the ground, posts designed to be inserted into a complementary receptacle, and portable posts having integral bases. It is also known to mount such nets using wall-mounted assemblies. Each of the above-listed types of net mounting apparatus have significant drawbacks in certain environments.

One environment of particular interest is in public recreational facilities, particularly schools. Net games, particularly volleyball, are particularly well-suited for physical education. Net games in general are non-contact and, as such, may be used when training groups of young age or mixed gender. Because net games are non-contact, they also reduce the chance of injury (which in turn reduces the risk of institutional liability). Volleyball in particular lends itself to group recreation in that a relatively large number of players may participate without requiring a large amount of equipment.

In the institutional setting, conventional net mount apparatus generally prove inadequate. The institutional setting typically includes a general multipurpose area such as an indoor or outdoor basketball court. Permanent, stationary posts cannot be used because they interfere with other uses of the area and oftentimes constitute dangerous obstacles. Posts designed to be imbedded in the ground cannot be used because these areas are generally asphalt if outdoors and concrete, wood or rubber if indoors. Furthermore, posts of this type are generally not stable enough for institutional use. Posts designed to be inserted in mated receptacles require the provision of such receptacles. The receptacles generally must be installed when the playing area is being constructed and, in any event, may take the form of dangerous holes or raised portions in the playing field.

Wall-mounted assemblies are often difficult to mount and/or to access because of bleachers or the like. Further, a net strung between two wall-mounted assemblies effectively bisects the gymnasium.

By far the most popular net mounting assemblies are "standards" (posts having integral bases). These assemblies weigh on the order of 60 to 80 lbs or more. Such standards often take the form of a rigid post imbedded in concrete which in turn is surrounded by a tire. The post may be turned to one side and rolled. In another design, the post is mounted on a heavy base which is provided with small wheels. The wheels often break. The standards oftentimes must be lifted up steps or raised stages in multipurpose rooms and gymnasiums by coaches, some of whom have incurred injuries. Both of these post designs are generally very awkward to move and the bases are a hazard to players and coaches. Furthermore, storage space must be provided for storing the assemblies when not in use.

The typical school gymnasium is an approximation of a regulation-size basketball court. Generally, basketball goals are provided at each end of the court and two on each side of the court. In order to allow as many as four simultaneous volleyball or badminton games to be played, the nets are set up between the side goals. Two nets of conventional length are supported by three of the aforesaid standards joining the nets. In the typical gymnasium, two set-ups of this type may be assembled. Commonly, the net set-up(s) must be broken down and reassembled frequently, as often as every other school class period. This means that three heavy standards per set-up must be moved regularly. Another drawback of this set-up is that the amount of tension which can be achieved across the nets is limited by the weight of the standards (i.e., the tension cannot be so great as to cause the end standards to lean). Additionally, three standards typically cost on the order of $600–$1,100.

Another need in the institutional setting is for adjustability of net height. In schools, for example, a wide range of age groups use the same equipment to play volleyball. A net height suitable for older students is generally too high for younger students.

Thus there exists a need for a net mounting system for mounting nets for games such as volleyball and badminton which provides for the easy and convenient removal of a net from a playing area. Further, there exists a need for such a net mounting assembly which, when the net is removed from the playing area, will not interfere with activity in the playing area. There exists a need for such a net mounting assembly which provides for adjustable net height. There also exists a need for such a net mounting assembly which is cost-effective to manufacture and install.

SUMMARY OF THE INVENTION

The present invention is directed to a retractable suspended net support which may be attached to a basketball backboard, a wall, or a similar surface. The net support is designed to be used in pairs, each assembly securing one of the two ends of an associated net. Each net support includes a frame and a carriage. The frame is mounted on the rear side of a basketball backboard or wall. For mounting on the backboard, the frame has a top mount which hooks over the top edge of the backboard and a bottom mount which is bolted onto a lower portion of the backboard. The carriage, which holds one end of the net is slidably mounted on the frame by means of a threaded rod. A winch is provided for adjusting the tension across the net. By means of a removable crank, the user may rotate the threaded rod and thereby raise and lower the carriage. Thus the carriage may be stored completely out of the way during use of the backboard for basketball and when not in use. Yet the carriage may be easily lowered for the attachment of a volleyball or badminton net.

It is an object of the present invention to provide a permanently attached net support for games such as volleyball and badminton, which may be stored on a basketball backboard and moved between a storage and an operative position.

Another object of the present invention is to provide a net support of the type described which further provides for the easy and convenient removal of a net from an operative position.

Another object of the present invention is to provide a net support as described above which, when the net is removed from the playing area, will not interfere with activity in the playing area.

Yet another object of the present invention is to provide a net support as described above which is cost-effective to manufacture and to install.

DETAILED DESCRIPTION OF THE PREFERRED EMBODIMENT

Figure 2:
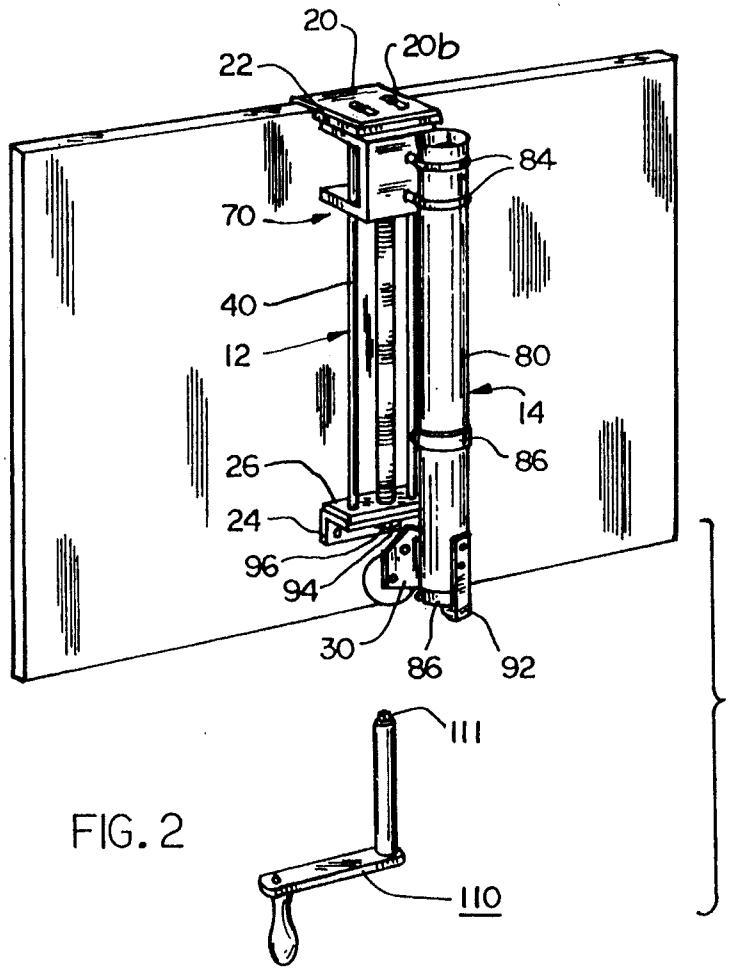
FIG. 2 is a rear perspective view of the net support of the present invention in a retracted position and a crank tool in exploded view.
Figure 4:
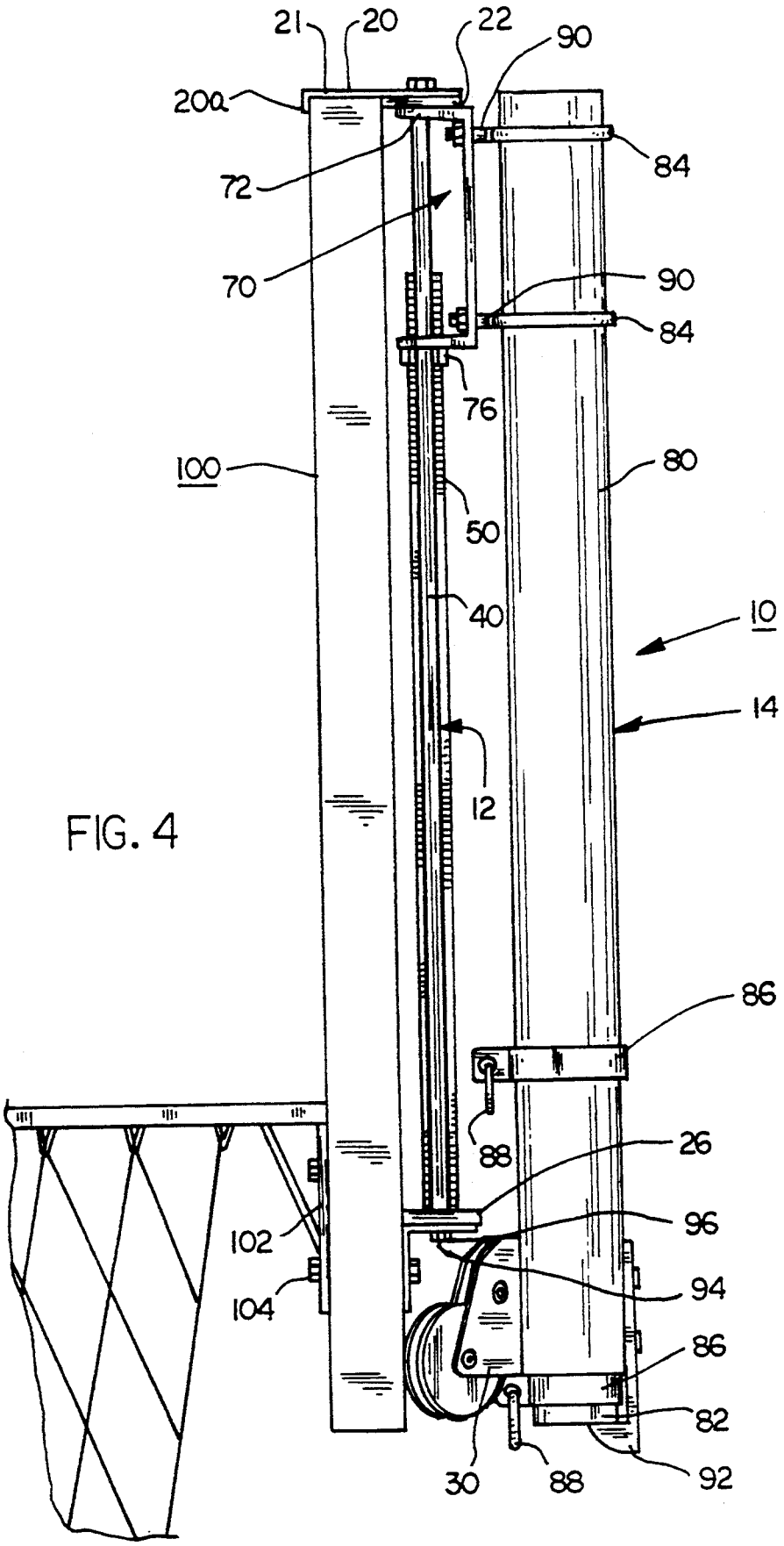
FIG. 4 is a side elevational view of the net support of the present invention mounted on a backboard in a retracted position.

Referring now to the figures and to FIGS. 2 and 4 in particular, a preferred embodiment of the net mounting support of the present invention, generally denoted 10, is shown therein mounted on a conventional backboard 100 in a retracted position. It will be noted that, when net support 10 is so mounted and positioned, support 10 is substantially obscured by backboard 100 and will not interfere with the use of backboard 100.

Figure 1:
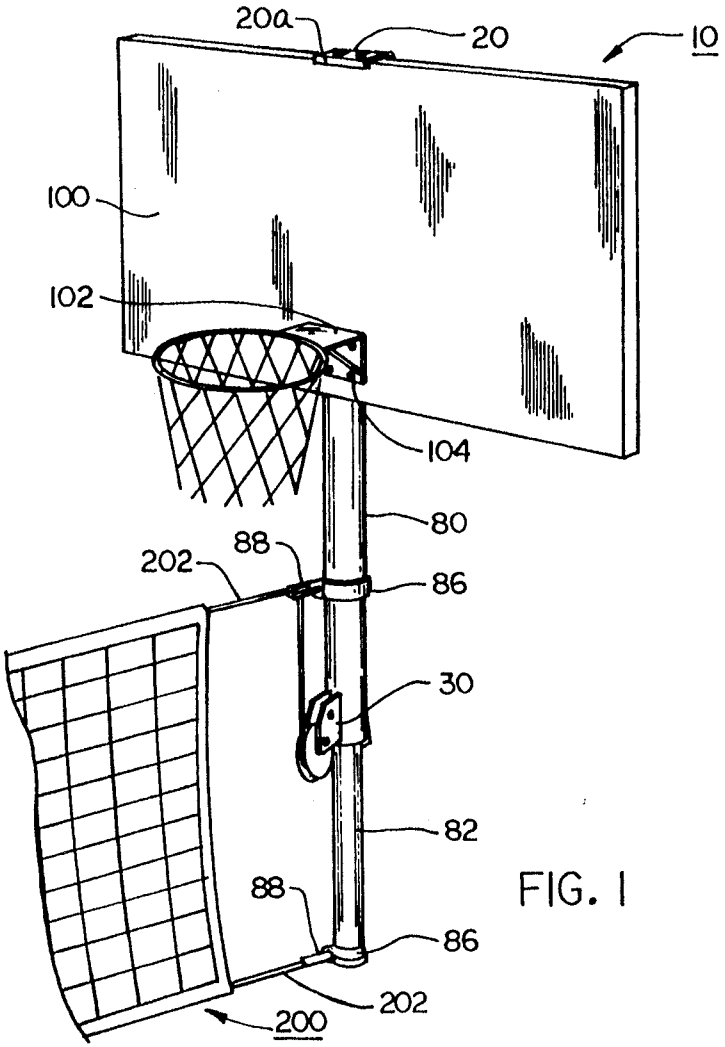
FIG. 1 is front perspective view of the net support of the present invention in an extended position.
Figure 3:
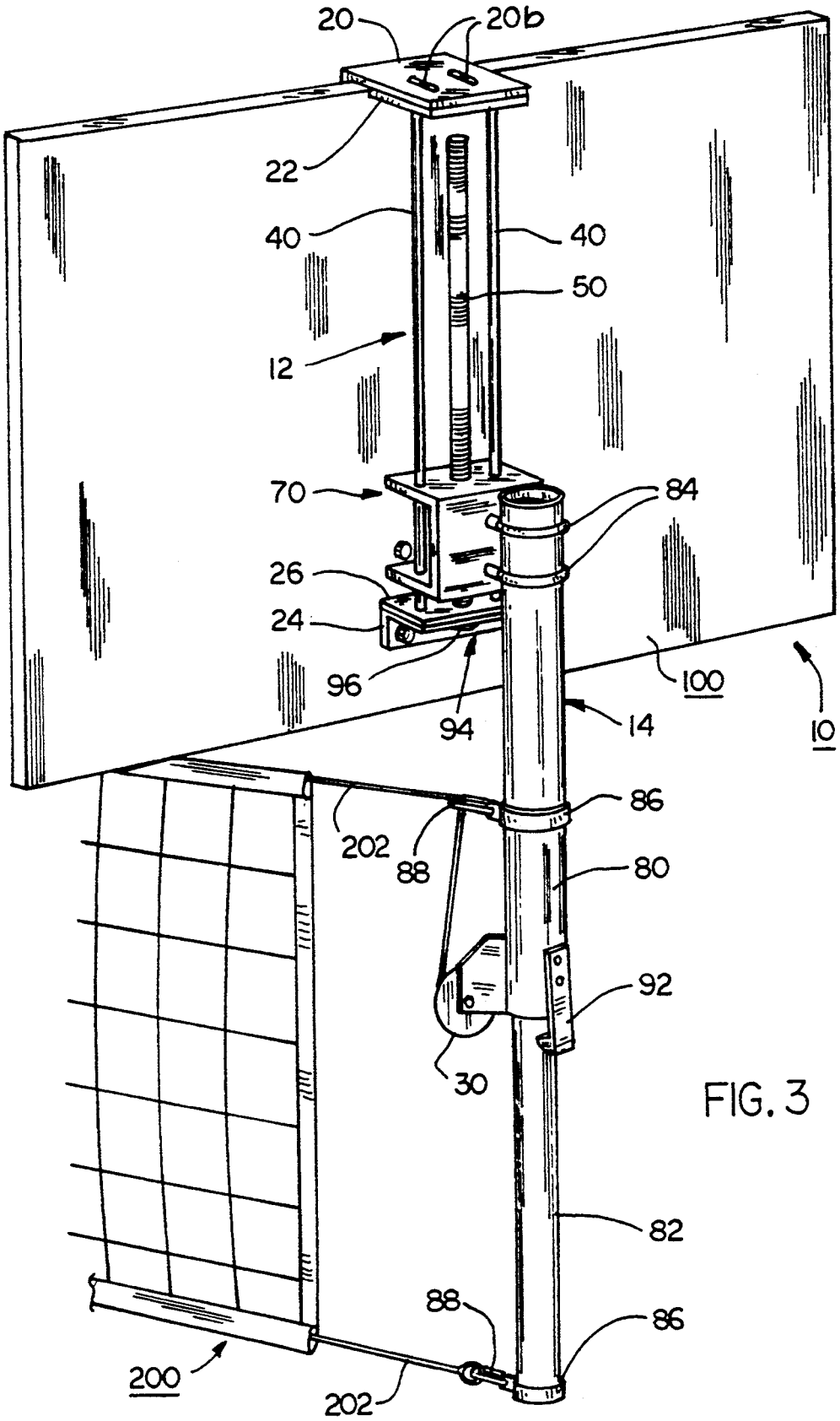
FIG. 3 is a rear perspective view of the net support of the present invention in an extended position.

Now referring to FIGS. 1 and 3, net support 10 is shown therein mounted on backboard 100 and disposed in an extended position. When so positioned, net support 10 is operative to support an end of a net 200 as shown. As shown and described following, net support 10 is designed for mounting a volleyball net. However, it will be appreciated that the net support of the present invention may be designed for use with other types of nets, such as badminton nets.

Turning now to support 10 in more detail, and as previously discussed, the support 10 includes a frame 12 and a carriage 14. The frame 12 is mounted to backboard 100 by top mount 20 and bottom mount 24. Top mount 20 includes a plate 21 and a downturned lip **20*a* which serves to suspend frame 12 from backboard 100. Bottom mount 24 is preferably joined to backboard 100 by bolts 104 which are inserted through conventionally pre-existing holes formed in backboard 100 for mounting goal 102**.

Screws **20*b* couple top mount 20 to top block 22 which abuts backboard 100 on one edge. Preferably, the holes in top mount 20 for receiving screws 20*b* are elongated slots to allow for adjustment between lip 20*a* and the edge of block 22 abutting backboard 100 so that lip 20*a* may be tightened against backboards of different thicknesses. Bottom mount 24** is an angle member which provides a bottom, horizontally extending guide rod and threaded rod support surface.

A pair of guide rods 40 extend between top and bottom blocks 22,26, thereby forming frame 12. The ends of rods 40 are rigidly secured to the blocks by any conventional means. This joining may be accomplished, for example, by welding, pins, bolts, or by threading the ends of rods 40 and providing nuts or threaded bores in the blocks. Guide rods 40 are preferably formed from steel and range from $\frac{3}{8}$ inch to 1 inch in diameter and from 36 inches to 48 inches in length.

Threaded rod 50 is rotatably mounted on bottom block 26 by means of, for example, a trust bearing. Socket 96 extends from threaded rod 50 and down through bottom block 26 and bottom mount 24, and further extends approximately 2 inches below bottom mount 24. An opening 94 is formed in socket 96 and is preferably configured to receive a standard ratchet head or the engagement head 111 of removable crank 110. Net support 10 is so configured that when socket 96 is rotated, threaded rod 50 rotates as a result and in the same direction. Threaded rod 50 is preferably threaded its entire length with Acme threads and is formed of steel. In the preferred embodiment, threaded rod 50 ranges from $\frac{1}{2}$ inch to 1 inch in diameter and from 36 inches to 48 inches in length.

Figure 5:
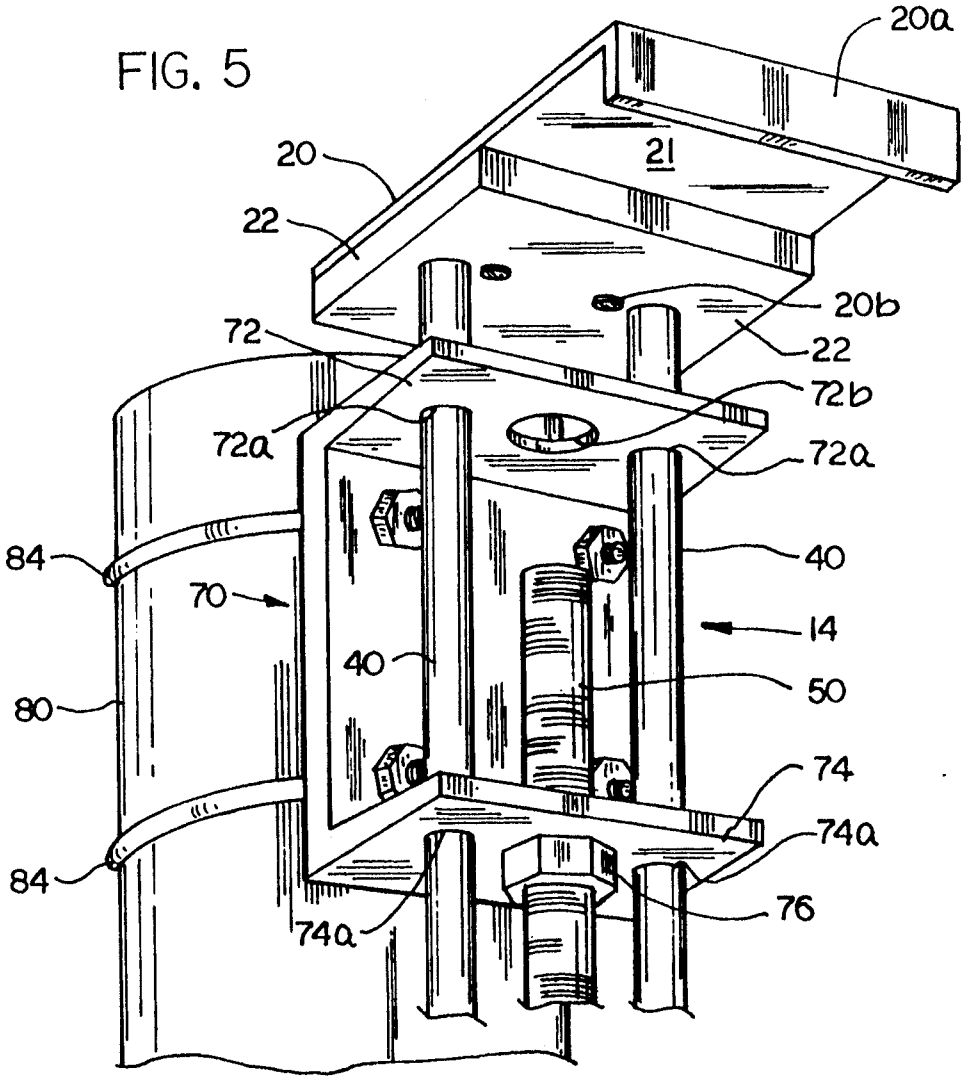
FIG. 5 is an enlarged, fragmentary view of the carriage and a top portion of the net support of the present invention.

As best seen in FIG. 5, a carriage bracket, generally 70, is disposed between top and bottom blocks 22,26. Carriage bracket 70 includes upper member 72 and lower member 74 which further include guide rod holes **72*a* and 74*a*, respectively, for slidably engaging guide rods 40. Upper member 72 includes hole 72*b* for slidably receiving threaded rod 50. Fixed nut 76 is fixedly mounted to lower member 74. Fixed nut 76 includes threads which are complementary to those of threaded rod 50 such that, when threaded rod 50 is rotated, nut 76 tends to ride up or down rod 50. It will be appreciated from the foregoing that, when threaded rod 50 is rotated, carriage bracket 70 will travel up or down (depending on the direction of rotation) threaded rod 50 and guide rails 40**.

Main member or tube 80 is fixedly mounted to carriage bracket 70 by U-bolts 84 and spacers 90. Extension 82 is partly disposed within main tube 80 such that a portion of extension 82 extends from the bottom end of main tube 80. Extension 82 is slidably mounted in main tube 80. In the preferred embodiment, extension 82 is supported by clip 92. Preferably, main tube 80 is formed from polymer (plastic) and is in the range of from 2 inches to 4 inches in diameter and from 36 inches to 48 inches in length. Preferably, extension 82 is formed from polymer (plastic) and is in the range of from $1\frac{1}{2}$ inches to $2\frac{1}{2}$ inches in diameter and from 24 inches to 36 inches in length.

Coupling rings or quick links 88 are mounted to main tube 80 and extension 82 by clamps 86. Clamps 86 are preferably of the type which may be loosened and reclamped. Winch 30 is also mounted on main tube 80 and may be positioned at an angle relative to the backboard if necessary to avoid binding with the backboard and to allow room for a manual or electric crank handle.

Net support 10 may be mounted on backboard 100 by hooking top mount 20 over the top edge of the backboard and bolting bottom mount 24 onto the lower portion using bolt 104. Additional means may be provided if desired to secure net support 10 more fully.

Net support 10 may be moved from a retracted position as shown in FIGS. 2 and 4 to an extended position as shown in FIGS. 1 and 3 as follows. First, a crank tool head 111 or the head of a ratchet is inserted into opening 94. As the ratchet head rotates socket 96, threaded rod 50 is likewise turned. Fixed nut 76 and therefore carriage bracket 70 travel down threaded rod 50. When carriage bracket 70 and thus main tube 80 are at a selected height, the crank tool or ratchet head may be removed. Clip 92 is then pulled away from the end of extension 82. Extension 82 is then pulled downward out of main tube 80. Main tube 80 and extension 82 are preferably configured such that, when in this position, a sufficient length of 82 (approximately 10 inches) will remain in main tube 80 to act as a cantilever which maintains their relative alignment even when extension 82 is subjected to the tension of the net. The upper and lower net lines 202 are then engaged with the upper and lower quick links 88, respectively, the top line being routed and secured to winch 30.

When placed in the extended position, the height of net support 10 may be adjusted in two ways. First, the overall height of carriage 14 may be raised or lowered by rotating threaded rod 50. Second, clamps 86 may be loosened so that the height and distance between quick links 88 may be manually adjusted.

Net support 10 may be returned to the retracted position by disengaging net lines 202, reinserting extension 82 into main tube 80 until clip 92 locks beneath the end of extension 82, and rotating threaded rod 50 in the counter direction.

Net support 10 may be mounted on a wall by simply using a top mount and a bottom mount adapted for that purpose, thereby making assembly 10 easily and inexpensively convertible from backboard mounting to wall mounting. It will be appreciated that even when mounted on a wall, net support 10 provides for the lowering and raising of the net above head-level.

Certain design modifications may be made. For example, threaded rod 50 may extend from top block 22 to bottom block 26. The advantage of the abbreviated threaded rod 50 as shown is that it is of a commercially available standard length.

The tool used to rotate socket 96 may be manual or motorized. Further, the tool may be integral with assembly 10. For example, a hand or electric-powered crank may be mounted on assembly 10 and interconnected with threaded rod 50.

Certain modifications to the present invention will be apparent to those skilled in the art and are intended to be encompassed within the scope of the following claims.

What is claimed is:

1. A retractable net support for mounting a net on a backboard, comprising:

a) a frame mountable by mounting means on the backboard, said mounting means including a top mount and a bottom mount configured and arranged to secure said frame to the backboard;

b) a carriage movable mounted in a substantially vertical direction on said frame, said carriage being selectively positionable along said frame;

c) said carriage having a net support post mounted thereon; and d) a coupling connected to said support post for securing the end of a net.

2. The net support of claim 1 wherein said top mount includes a downturned lip for suspending said frame from the top edge of the backboard.

3. The net support of claim 1 wherein said bottom mount is connected to the rear side of the backboard using the same bolts as used to mount a basketball goal to the backboard.

4. The net support of claim 1 further including a threaded rod rotatably mounted on said frame wherein, when said threaded rod is rotated, said carriage is moved relative to said frame.

5. The net support of claim 4 further including a carriage bracket secured to said carriage, mounted on said threaded rod, and interconnecting said threaded rod and said net support post.

6. The net support of claim 1 wherein paid net support post includes an extension carried thereby, said extension operative to effectively extend the length of said net support post.

7. The net support of claim 4 wherein a socket is formed on one end of said threaded rod, said socket being arranged and configured to engage a crank for rotating said threaded rod.

8. A retractable net support system for mounting a net between a pair of separate vertical support surfaces, comprising:

a) a pair of frames, one of said frames mountable on one of the vertical support surfaces and the other of said frames mountable on the other vertical support surface;

b) each of said frames having a carriage movably mounted in a substantially vertical direction on said frame, said carriage being selectively positionable along said frame;

c) each of said carriages having a net support post mounted thereon; and d) couplings connected to each of said support posts for securing the ends of a net.

9. The net support system of claim 8 wherein the vertical support surfaces are generally planar and opposed to one another such that said net is suspended therebetween.

10. The net support system of claim 8 further including mounting means, said mounting means including a top mount and a bottom mount configured and arranged to secure each of said frames to its respective vertical support surface.

11. The net support system of claim 8 further including a threaded rod rotatably mounted on each of said frames wherein, when said threaded rod is rotated, said carriage is moved relative to said frame.

12. The net support system of claim 11 further including a carriage bracket secured to said carriage, mounted on said threaded rod, and interconnecting said threaded rod and said net support post.

13. The net support system of claim 8 wherein each of said net support posts includes an extension carried thereby, said extension operative to effectively extend the length of said net support post.

14. The net support system of claim 11 wherein a socket is formed on one end of said threaded rod, said socket being arranged and configured to engage a crank for rotating said threaded rod.

15. A retractable net support for mounting the end of a net on a vertical support surface, comprising:

a) a frame mountable on the vertical support surface;

b) a carriage movably mounted in a substantially vertical direction on said frame, said carriage being selectively positionable along said frame;

c) a threaded rod rotatably mounted on said frame wherein, when said threaded rod is rotated, said carriage is moved relative to said frame;

d) said carriage having a net support post mounted thereon; and e) a coupling connected to said support post for securing the end of the net.

16. The net support of claim 15 further including a carriage bracket secured to said carriage, mounted on said threaded rod, and interconnecting said threaded rod and said net support post.

17. The net support of claim 15 wherein said net support post includes an extension carried thereby, said extension operative to effectively extend the length of said net support post.

18. The net support of claim 15 wherein a socket is formed on one end of said threaded rod, said socket being arranged and configured to engage a crank for rotating said threaded rod.

* * * * *

UNITED STATES PATENT AND TRADEMARK OFFICE

CERTIFICATE OF CORRECTION

PATENT NO. : 5,393,069

DATED : February 28, 1995

INVENTOR(S) : Stevie R. Taylor

It is certified that error appears in the above—identified patent and that said Letters Patent is hereby corrected as shown below:

Title page, item [54], change the title of the invention from "RETRACTABLE BACKBOARD SUSPENDED NOT SUPPORT" to "RETRACTABLE BACKBOARD SUSPENDED NET SUPPORT."

Column 1, line 2-3, above the heading FIELD OF THE INVENTION, change the title of the invention from "RETRACTABLE BACKBOARD SUSPENDED NOT SUPPORT" to "RETRACTABLE BACKBOARD SUSPENDED NET SUPPORT."

Signed and Sealed this

Sixteenth Day of May, 1995

*Attest:*

Bruce Lehman

BRUCE LEHMAN

*Attesting Officer*

*Commissioner of Patents and Trademarks*